US005119878A

United States Patent [19]

Lee

[11] Patent Number: 5,119,878

[45] Date of Patent: Jun. 9, 1992

[54] IMPACT ACTIVATED VEHICLE-BASED FIRE EXTINGUISHER

[76] Inventor: Robey M. Lee, 67 Kings Hwy., Hackettstown, N.J. 07840

[21] Appl. No.: 667,643

[22] Filed: Mar. 11, 1991

[51] Int. Cl.[5] ..... A62C 3/07; A62C 3/08

[52] U.S. Cl. ..... 169/62; 169/58; 169/70; 169/26

[58] Field of Search ..... 169/62, 56, 70, 26, 169/57, 58

[56] References Cited

U.S. PATENT DOCUMENTS

| | | | |
|---|---|---|---|
| 1,838,655 | 12/1931 | Bronander . | |
| 1,925,242 | 9/1933 | Gabbetis | 169/58 |
| 2,025,326 | 12/1935 | Bouillon . | |
| 2,560,468 | 7/1951 | Morton | 169/26 |
| 2,747,674 | 5/1956 | Hodges | 169/58 |
| 2,774,432 | 12/1956 | Danziger | 169/57 |
| 2,800,966 | 7/1957 | McKissick | 169/26 X |
| 2,824,614 | 2/1958 | Bowman | 169/26 |
| 2,841,228 | 7/1958 | Porterfield | 169/58 |
| 3,876,011 | 4/1975 | Poitras . | |
| 3,961,669 | 6/1976 | Kaneko . | |
| 4,893,680 | 1/1990 | Wittbrodt et al. . | |

*Primary Examiner*—Margaret A. Focarino
*Assistant Examiner*—James M. Kannofsky
*Attorney, Agent, or Firm*—Kenneth P. Glynn

[57] ABSTRACT

The present invention is directed toward an automobile fire extinguishing device that is applicable to all modes of transportation. The present invention retains a volume of pressurized fire retarding material which is kept within the container by a trigger cap that suspends a weight within a larger tubing juncture enclosure. As the invention experiences an abnormal acceleration force from a collision, the interia of the suspended weight breaks the trigger cap and releases the fire retarding material into the tubing juncture enclosure. The tubing juncture enclosure routes the fire retarding material into a plurality of tubes that extend to various potential fire sites. Similarly, the part of the trigger cap that suspends the weight is sensitive to heat. If an abnormally high heat is incurred, the weight will buckle the cap releasing the fire retarding material.

17 Claims, 2 Drawing Sheets

IMPACT ACTIVATED VEHICLE-BASED FIRE EXTINGUISHER

BACKGROUND OF THE INVENTION

1. Field of the Invention

The present invention is directed toward automatically activated fire extinguishing device for engine driven modes of transportation, and more specifically to fire-extinguishing devices that automatically expel a fire retarding substance when exposed to a predetermined high temperature or subjected to a violent change in acceleration.

2. Prior Art Statement

From the earliest steam engine to the most advanced jet turbine engine, all self-contained engines run by the controlled burning of fuels. Engines are used to drive every mode of transportation known (i.e. automobiles, planes, trains, and boats). Occasionally, under the best of circumstances, engine parts fail and heat of the engine causes uncontrolled fires. But when an automobile, plane, train or boat is involved in a collision, and the integrity of the fuel supply or engine is compromised, the chances of an uncontrolled fire is increased dramatically.

The present invention is a fire extinguishing device that can be used wherever an engine is used. The present invention releases and directs fire extinguishing material when triggered by an abnormally high temperature or a violent change in acceleration. Such fire extinguishing devices have generally been in existence since the first engines, but no device has yet been made that works as dependably or is as versatile as the present invention. Prior art fire extinguishers for differing modes of transportation are exemplified by the following:

U.S. Pat. No. 1,838,655 to Bronander shows a volume of fire extinguishing fluid stored within a breakable container. When the container experiences a violent change in acceleration, the container contacts its encasement and ruptures. The fire extinguisher fluid flows out and down onto any mechanism positioned below.

U.S. Pat. No. 3,961,669 to Kaneko shows a double container device wherein one container of compressed gas is stored within a container of fluid. The device is activated by a directed blow to a plunger that ruptures the inner container and combining the two elements. The result is that the liquid leaves its container under pressure for use in extinguishing a fire;

U.S. Pat. No. 4,893,680 to Wittbrodt et al shows a fire extinguishing system that is activated electrically through electrical sensors, the sensors being triggered by deformation during an impact; and U.S. Pat. No. 3,876,011 to Pultras and U.S. Pat. No. 2,025,326 to Bouillon both show fire extinguishing devices activated by both heat and acceleration. Both devices have plungers that rupture storage facilities by the sudden change acceleration caused by a collusion or by heat releasing a spring bias to the rupturing plunger.

Thus, although prior art does show fire extinguishing devices that are triggered by abnormal temperature or acceleration changes, prior art neither teaches nor suggests a fire extinguishing device such as the present invention. The present invention is a small compact unit, and unlike prior art, a plurality of devices can be placed throughout potential fire areas. Additionally, the present invention has a minimal number of moving parts and is triggered regardless to its orientation during a collision. Consequently, the present invention results in a fire extinguishing device that is less expensive, more reliable, and more versatile than any other such device that exists in prior art.

SUMMARY OF THE INVENTION

The present invention is directed toward an automobile fire extinguishing device that is applicable to all modes of transportation. The present invention retains a volume of pressurized fire retarding material, kept within the container by a trigger cap that suspends a weight within a larger tubing juncture enclosure. As the invention experiences an abnormal acceleration force from a collision, the interia of the suspended weight breaks the trigger cap and releases the fire retarding material into the tubing juncture enclosure. The tubing juncture enclosure routes the fire retarding material into a plurality of tubes that extend to various potential fire sites. Similarly, the part of the trigger cap that suspends the weight is sensitive to heat. If an abnormally high heat is incurred, the weight and the pressure of the stored material will buckle the cap releasing the fire retarding material.

BRIEF DESCRIPTION OF THE DRAWINGS

The invention will be more fully understood by referring to the following detailed specifications, the above specification and the claims set forth herein, when taken in connection with the drawings appended hereto, wherein:

DETAILED DESCRIPTION OF THE PRESENT INVENTION

Fuel storage tanks, fuel lines, fuel pumps, oil and extreme heat are essential elements to every form of combustion engine. Consequently, such elements are essential parts of every mode of transportation that is powered by such an engine. When the integrity of such a system is compromised by a machine part failure or collision, fire is almost an inevitable outcome. Fires in automobiles, planes, trains and boats have killed thousands of people and caused millions of dollars worth of damage. The present invention shows an inexpensive, compact and highly reliable device that automatically propels fire retarding material onto potential fire areas after a violent collision or encountering an abnormally high temperature. The present invention can be incorporated into any mode of transportation and has a triggering system and delivery system that is more dependable than any other device that performs the same function.

Figure 1:
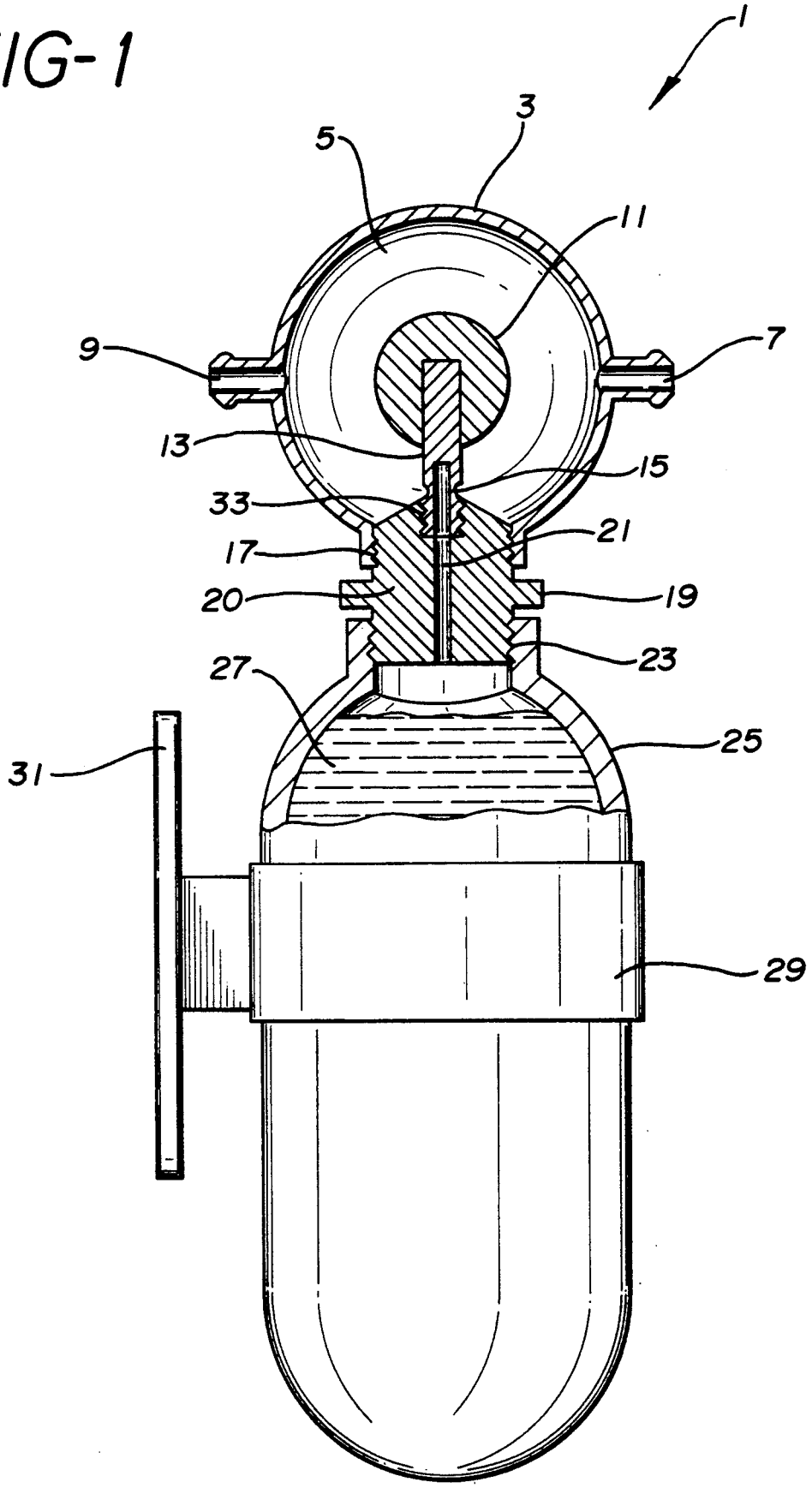
FIG. 1 shows a partially cross sectioned side view of one preferred embodiment of the present invention.

Referring to FIG. 1 a side view of onepreferred embodiment of the present invention 1 is shown. The figure is partially shown in cross section to best illustrate the functioning of the claimed device. As is illustrated, a volume of fire extinguishing material 27 is stored under pressure within a container 25. The extinguishing material 27 can be either a liquid or foam and preferably would be a material such as HALON The container 25 has at least one exit orifice that is closed by a cap 20. The cap 20 in the shown preferred embodiment has exterior threading 23 that engages a sympathetically threaded neck to the container 25. The cap 20 is turned into the container 25 by a mounting nut 19 formed as part of the cap 20. It should be understood that although the cap 20 is shown as threading into the container 25, any means of engagement, such as welding, gluing or the like, can be used to affix the two parts. Additionally the cap 20 and the container 25 may be manufactured as one continuous part wherein the need for the mounting nut 19 would be removed.

The container cap 20 has a fluid flow conduit 21 transgressing its length. The conduit is sealed at one end by a trigger stop 13. The trigger stop 13 preventing the flow of the fire retaining material 27 through the conduit 21. The trigger stop 13 may be partially hollow and extends the length of the flow conduit 21 up into the material of the trigger stop 13. At some point along the outside circumferential edge of the trigger stop, surrounding the conduit 21, a break ring 15 is formed into the material of trigger stop 13. The break ring concentrates any stresses applied to the trigger stop 13 and provides a weak point where the trigger stop will fracture if stressed beyond its yield point. The trigger stop 13, as shown by FIG. 1, is made of a differing material than the container cap 20. The trigger stop 13 is threaded 33 into the cap 20 along the center axis of the flow conduit 21. The purpose of having the trigger stop 13 made as a separate part from the container cap 20 is that the trigger stop 13 must be made from a material that is highly heat sensitive, a characteristic that is unnecessary to the container cap 20.

The trigger stop 13 supports a weight 11 and is surrounded by a tubing junction enclosure 3. The weight 11 increases the stresses on the trigger stop 13. As the weight 11 is subjected to an abnormal acceleration or deceleration, as would occur during a collision, the inertia or momentum of the weight 11 would create stresses on the trigger stop 13 that could not be supported by the break ring 15. The result being the material of the trigger stop 13 yielding at the break ring 15 and rupturing the integrity of the flow conduit 20. Similarly, since the material of the trigger stop 13 has a low melting point, when the trigger stop 13 encounters an abnormally high temperature the combination of the support weight 11 and the pressure of the fire extinguishing fluid 27 will cause the softened trigger stop 13 to yield at the break ring 15. The result again being the rupture of the flow conduit 21 and the release of the stored fire extinguishing fluid 27.

Once heat or sudden impact has caused the trigger stop 13 to break, the fire extinguishing material 27 will stream through the flow conduit 21. The fire extinguishing material 27 is gathered in the tubing junction enclosure 3 that serves a dual purpose. First, the tubing junction enclosure 3 forces the fire extinguishing material 27 to flow into a plurality of escape orifices 9, 7 that attach to lengths of tubing (not shown). The tubing directs the fire extinguishing material to areas of potential fire, such as the engine block, gas tank, gas pump, etc. The endings of such tubs may include various nozzles to efficiently and effectively distribute the fire extinguishing material 27.

The second purpose of the tubing junction enclosure 3 is that it protects the trigger stop 13 or weight 11 from being accidentally touched or corroded prior to its actual use. Since the trigger stop 13 is calibrated to yield to a maximum change in acceleration or temperature, the added weight or insulation effect caused by dirt or debris could change the effectiveness of the device.

The present invention 1 can attach to any machine that moves such as a car, plane, boat, etc. The desired mode of attachment for the present invention 1 is the shown clamp 29 and the attached mounting bracket 31. The clamp 29 may be welded, glued, or mechanically fastened to the container 25 and the bracket 31 can be similarly attached to the desired apparatus.

Figure 2:
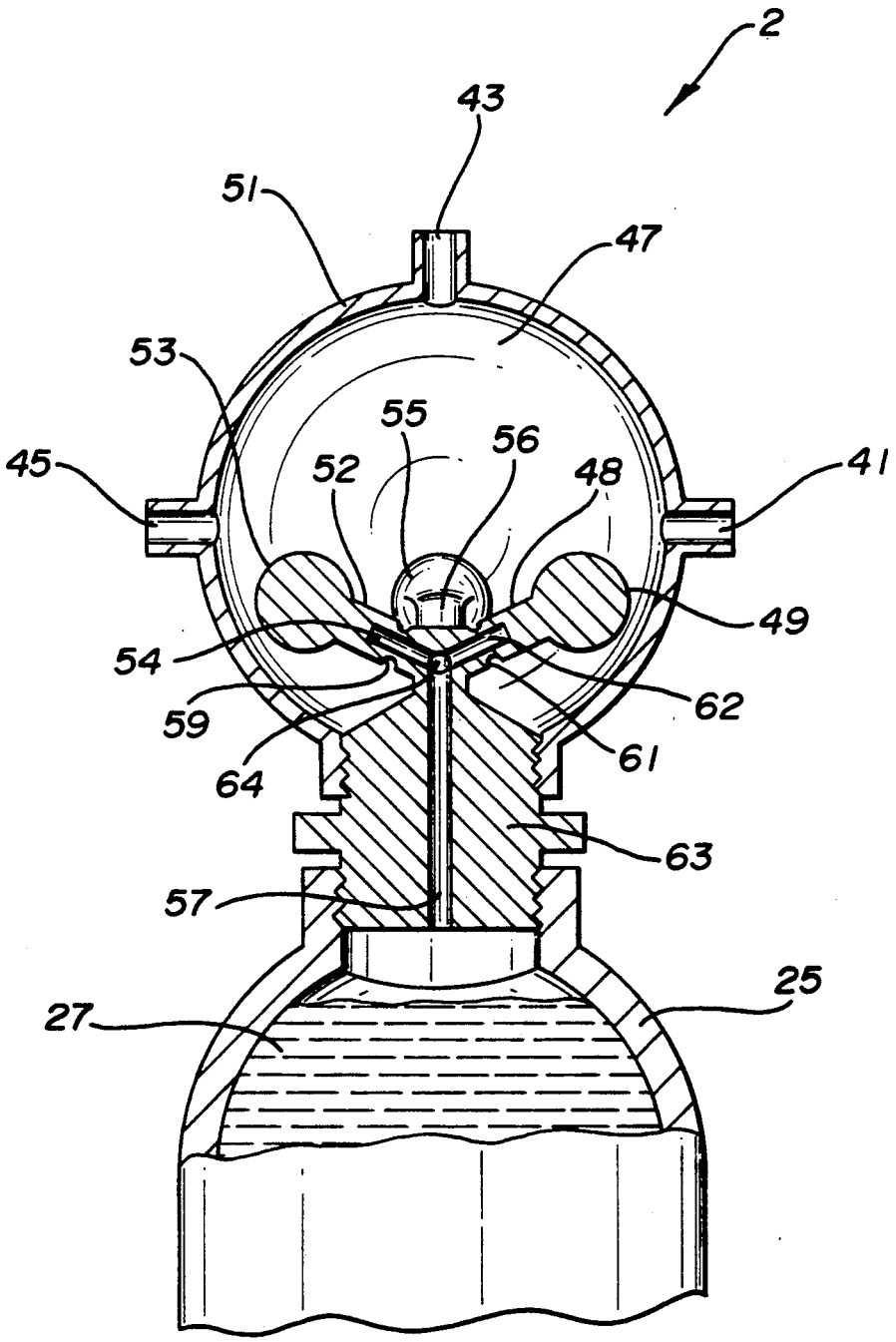
FIG. 2 shows a fragmented cross sectioned side view of a second embodiment of the present invention.

Once the present invention 1 has been activated, it may be replaced with a new unit or it can be recharged and reused. To recharge the unit, the tube junction enclosure 3 would be removed from around the trigger stop 13 by disengaging the threading 17 between the junction enclosure 3 and the cap 20. Once removed the trigger stop 13 can be removed from the cap 20. The fire extinguishing material 27 can then be replaced and a new trigger stop 13 can be installed, readying the invention 1 for another cycle of use. Referring now to FIG. 2 an alternative embodiment of the present invention 2 is shown. FIG. 2 is fragmented and shown in partial cross section to show working mechanisms and to avoid repetition of parts described in the prior embodiment. In the embodiment shown by FIG. 2 the container cap 63, weights 53, 55, 49 and trigger stops 52, 56, 48 are unistructural and formed of the same material. The flow conduit 57 travels from the container 25, through the cap 63 and up toward the trigger stops 52, 56, 48. As the conduit approaches the trigger stops 52, 56, 48 it splits, entering each trigger stop 52, 56, 48 creating branch conduits 59, 64, 61 that partially transgress the length of each. On each trigger stop 52, 56, 48 is a break ring 59, 61. Each break ring 59, 61 providing the weakest point along each of the trigger stops 52, 56, 48. Each trigger stop 52, 56, 48 suspends a weight 53, 55, 49. The weights 53, 55, 49 are positioned off center from the center axis of the cap 63 and may, or may not, be in a symmetrical arrangement. The offset orientation of the weights 53, 55, 49 assure that one of the triggers stops 52, 56, 48 will experience a large bending moment regardless to the orientation of the invention 2 during a collision. Additionally, multiple trigger stops 52, 56, 48 ensure the reliability of the invention 2.

The material of the trigger stops 52, 56, 48 is heat sensitive, having a low melting point. If the trigger stops 52, 56, 48 encounter an abnormally high temperature, or if the trigger stops 52, 56, 48 yield to the inertial or momentum force of the weights 53, 55, 49 during a collision, then the branch conduits 59, 64, 61 rupture releasing the fire extinguishing material 27. In this embodiment the released fire extinguishing material would enter a tube junction enclosure 51 similar to the embodiment previously described with FIG. 1. Except in the embodiment of FIG. 2 three escape orifices 45, 43, 41 are shown, exemplifying the fact that any number of escape orifices can be used with this invention.

In light of the above described embodiments it must be understood that many variations of the invention can be created. The embodiments shown depict the best mode of the invention but it is obvious that numerous shapes, sizes and orientations can be used for all the parts described. It should therefore be understood that in light of the appended claims, the invention may be practiced other than as specifically described, and individual features described in differing embodiments may be modified, combined or used in orientations other than those shown.

What is claimed is:

1. An automatically activated fire extinguishing device for all motorized modes of transportation, said device comprising:

(a) a fluid container having at least one orifice for the passage of fluid therethrough, said fluid container holding a volume of fire extinguishing material under pressure;

(b) a container cap having at least one fluid flow conduit formed therethrough, said cap covering said orifice within said fluid container, leaving said at least one fluid flow conduit as the only avenue of fluid flow from said container;

(c) at least one trigger stop affixed to said container cap and extending away from said container, said at least one trigger stop temporarily obstructing said at least one fluid flow conduit;

(d) at least one weight affixed to, and supported by said at least one trigger stop;

(e) at least one tubing juncture enclosure surrounding said at least one trigger stop, said at least one tubing enclosure having a solid circumferential skin pierced by at least one escape orifice.

2. The device of claim 1, wherein a predetermined violent change in acceleration will cause said at least one trigger stop to break, creating a clear passage between said at least one fluid flow conduit and said at least one tubing juncture enclosure.

3. The device of claim 2, wherein a grooved relief is formed on said at least one trigger stop below said at least one weight, said relief providing a thin spot in the material of said at least one trigger stop creating a predetermined area of fracture when said at least one trigger stop encounters a predetermined violent change in acceleration.

4. The device of claim 2, wherein said at least one trigger stop is composed of a heat sensitive material, said at least one trigger stop yielding at a predetermined high temperature, creating an open passage between said at least one fluid flow conduit and said at least one tubing juncture enclosure.

5. The device of claim 4, wherein said at least one trigger stop comprises a plurality of trigger stops that extend from said container cap in a plurality of angles and orientations.

6. The device of claim 4, wherein said at least one trigger stop breaks when subjected to a high temperature from 70 degrees Celsius to 150 degrees Celsius.

7. The device of claim 2, wherein said at least one trigger stop breaks when subjected to a change in acceleration from $\pm 13$ meters per second squared to $\pm 30$ meters per second squared.

8. The device of claim 1, wherein said container cap and said at least one trigger stop are one unistructural piece composed of the same material.

9. The device of claim 1, wherein said at least one weight and said at least one trigger stop are one unistructural piece composed of the same material.

10. The device of claim 1, wherein said at least one escape orifice on said at least one tubing juncture enclosure leads into a tubing coupler extension.

11. The device of claim 1, wherein a preformed mounting bracket is attached to said device.

12. The device of claim 1, wherein said container cap has one of said at least one fluid flow conduit adjoining said fluid container, said one of said at least one fluid flow conduit branching off into a plurality of directions extending into said at least one trigger stop.

13. The device of claim 1, wherein said at least one trigger stop is replaceably removable from said container cap.

14. The device of claim 1, wherein said fire extinguisher material is a liquid.

15. The device of claim 1, wherein said fire extinguisher material is a foam.

16. The device of claim 1, wherein said at least one tubing juncture enclosure is removable.

17. The device of claim 1, wherein said fire extinguishing material is HALON (TM).

* * * * *